United States Patent [19]

Beard

[11] Patent Number: 4,996,809

[45] Date of Patent: Mar. 5, 1991

[54] STRUCTURAL GLAZING SYSTEMS FOR SKYLIGHTS

[76] Inventor: Philip W. Beard, Rte. 2 Box 171, LeCompte, La. 71346

[21] Appl. No.: 335,731

[22] Filed: Apr. 10, 1989

Related U.S. Application Data

[63] Continuation-in-part of Ser. No. 153,324, Feb. 8, 1988, Pat. No. 4,850,167.

[51] Int. Cl.[5] ..... E04B 7/18

[52] U.S. Cl. ..... 52/200; 52/235; 52/397

[58] Field of Search ..... 52/235, 397, 396, 200, 52/395, 468

[56] References Cited

U.S. PATENT DOCUMENTS

| | | | |
|---|---|---|---|
| 3,266,207 | 8/1966 | Birum | 52/235 |
| 3,321,880 | 5/1967 | Ferrell | 52/235 |
| 3,380,210 | 4/1968 | Neal | 52/235 |
| 3,553,918 | 1/1971 | Dauson | 52/235 |
| 3,734,550 | 5/1973 | Vance | 52/235 |
| 3,785,104 | 1/1974 | Dailen | 52/235 |
| 3,932,974 | 1/1976 | Wright | 52/468 |
| 4,070,806 | 1/1978 | Hubbard | 52/395 |
| 4,141,188 | 2/1979 | Sukolics | 52/395 |
| 4,455,798 | 6/1984 | Tsakiris | 52/200 |
| 4,621,472 | 11/1986 | Kloke | 52/200 |
| 4,683,693 | 8/1987 | Rockar | 52/235 |

*Primary Examiner*—John E. Murtagh
*Attorney, Agent, or Firm*—John M. Harrison

[57] ABSTRACT

Structural glazing systems for skylights which are designed to facilitate installation, maintenance and replacement of skylight panels from inside a host structure. The internal fastening apparatus of the structural glazing systems include multiple, open-chamber carrier beams which are interconnected in a lattice or grid configuration and include upward-standing glazing strip supports shaped to receive a pair of parallel, spaced bottom glazing strips for accommodating the bottom edges of separate glass or plastic skylight panels. Companion exterior glazing caps each carry a pair of spaced top glazing strips for seating on the top edges of the skylight panels. The exterior glazing caps are shaped to facilitate bolting to the carrier beams and securing the glass or plastic skylight panels in position between the top and bottom glazing strips. A carrier beam closure is designed to removably close the open chamber of each hollow carrier beam and to facilitate concealment of, and access to, the multiple cap bolts which are used to bolt the carrier beams to the corresponding exterior glazing caps, respectively. A system of condensate gutters is provided on the carrier beams, which gutters meet at the points of intersection of the carrier beams to carry condensate away from the glass or plastic panels.

4 Claims, 2 Drawing Sheets

STRUCTURAL GLAZING SYSTEMS FOR SKYLIGHTS

CROSS-REFERENCE TO RELATED APPLICATION

This application is a Continuation-In-Part of my copending U.S. Patent Application Ser. No. 153,324, filed Feb. 8, 1988, now U.S. Pat. No. 4,850,167.

BACKGROUND OF THE INVENTION

1. Field of the Invention

This invention relates to structural glazing systems for skylights in solaria, greenhouses, barrel vaults and like structures and more particularly, to skylight structural glazing systems having an internal fastening network which effectively eliminates the need for exterior fasteners, holes and slots normally used in conventional skylight mounting and support systems. The structural glazing systems of this invention include a bottom closure system for securing glass or plastic skylight panels between straight runs of the carrier beam supporting members and a side closure system for mounting the panels between carrier beam structural members extending over walls, headers, sills or jambs in a structure. Each of the bottom and side closure systems includes multiple, specially designed, open-chamber carrier beams which are each shaped to receive a pair of spaced, parallel, elevated carrier glazing strips for engaging the edges of the bottom surfaces of a pair of adjacent glass or plastic skylight panels to be mounted. Multiple companion exterior glazing caps, each of which includes a pair of spaced cap glazing strips for engaging the edges of the top surfaces of the glass or plastic skylight panels are also provided, for securing the skylight panels between the exterior glazing caps and the corresponding carrier beams by means of spaced cap bolts, which are inserted from the underside of the carrier beams through spaced openings provided therein, into the exterior glazing caps. A carrier beam closure is removably fastened to the bottom edges of some of the carrier beams and to the side edges of other carrier beams, to close the chamber, conceal the cap bolts and facilitate access to the cap bolts from the inside structure for removal of the skylight panels without the necessity of traversing the roof of the structure. Moreover, where necessary for structural purposes, stabilizer clips are mounted in the carrier beams, in order to stiffen the carrier beams.

Conventional skylight glazing systems for residential, commercial and other structures, such as fixed or movable, sloped or curved glazing in solaria, greenhouses and barrel vaults, in non-exclusive particular, are normally designed to facilitate access to the glass or plastic skylight panels from the roof of the structure in which the skylight panels are installed. These glazing systems typically include various fasteners and sealing systems which are accessed from the roof of the structure, in order to replace damaged glass or plastic skylight panels or to perform routine maintenance on the glazing system structural elements. A primary problem which is frequently realized in conventional structural glazing systems is that of seating and sealing the panels within the structural members in such a manner as to prevent leakage of water and infiltration of dust and other undesirable elements through the system and yet facilitate efficient maintenance of the installation.

Sloped or overhead skylight glazing systems gene: ally include multiple horizontal framing members inte: connected with cooperating vertical framing membe: to form a structural framing grid or lattice which de fines multiple glazed openings of selected size, int which openings glass or plastic panels are installed. Th grid may be pitched or sloped at a selected angle wit respect to the horizontal or it may be rounded, as in greenhouse, and various forms of connecting and sea ing components are employed to secure the panei within the glazing openings, to minimize infiltration c moisture, air and dust from the outside to the inside c the structure. Typical sealing components include resi ient ceiling gaskets which grip the inner and outer pane surfaces, together with means for tightening these gas kets against these surfaces to create water and air-tigh connections. Calk is also sometimes used to facilitat such water, air and dust-tight connections.

2. Description of the Prior Art

Various structural glazing systems are known in th prior art for mounting glass skylight panels on sloped o overhead glazing systems, including greenhouses. Typi cal of these systems is the Modular Solar Greenhous detailed in U.S. Pat. No. 4,462,390, dated July 31, 1984 to Holdridge, et al. The modular solar greenhouse de tailed in this patent incorporates rigid, curving over head frames provided with screw and nut tracks fo ease of assembly and also uses companion east side an west side end modules for mounting a thermally broke glazing system. The exterior and interior portions of th aluminum frame extrusions are bonded together by strong plastic material and at least one overhead hea storage unit is carried by the rigid frame. A "Ventilatin Skylight" is detailed in U.S. Pat. No. 4,449,340, date May 22, 1984, to Arthur P. Jentoft, et al. The skyligh includes a domed or flat glazing which is adapted to fi within the opening of a roof having a peripheral fram which is fixed to the roof about the opening. The fram is characterized by a base frame and an operating lea frame and a retainer is used to secure the skylight cove over the operating leaf frame. U.S. Pat. No. 4,621,472 dated Nov. 11, 1986, to Werner Kloke, details "Glazed Structural System and Components There fore". The patent discloses skylight structures wherei the supporting and supported structural members defin ing the metal framework, including flange formation upon which the glass panels are secured, are provide with longitudinally-extending drainage channel forma tions. The open ends of the drainage channel formation of the supported structural members intersect and over lap the drainage channel formations of the supportin structural members. Accordingly, water collecte therein is discharged into the drainage channel forma tions of the supporting structural members at a poin remote from the intersections thereof. The structura members are interconnected by displaceable clampin means carried by the overlapping ends, including a cli embracing the ends from below in the region of overla and upon displacement, upwardly engage the flang formations of the supporting structural members fron below. A "Rafter with Internal Drainage Feature an Sloping Glazing System Incorporating Same" is de tailed in U.S. Pat. No. 4,680,905, dated July 21, 1987, t James A. Rockar. The patent details a sloped curtai wall or glazing system for a building, which syste includes a plurality of rafters and purlins interconnecte to provide at least one panel opening for retaining panel. The rafters have an upwardly sloping vertica glazing pocket adapted to receive a vertical marginal edge portion of a panel and the purlins have a horizontal glazing pocket adapted to receive a horizontal marginal edge portion of a panel. The rafters further include a semi-enclosed drainage channel and a condensate gutter which are not disposed in fluid communication with either the drainage channel or the vertical glazing pocket. The purlins further include a condensation gutter and the purlin and rafter condensation gutters are disposed in fluid communication with each other. The drainage channel is provided with at least one opening to put the vertical and horizontal glazing pockets in communication therewith. The glazing system further includes a seal for separately collecting and discharging the infiltration moisture collected in the drainage system and the condensation moisture collected in the rafter condensation gutter.

It is an object of this invention to provide new and improved sloped or curved structural glazing systems for skylights which effectively eliminate the need for conventional exterior fasteners, slots, sealing devices and holes commonly used for installing, maintaining and replacing glass and plastic skylight panels.

Another object of the invention is to provide a new and improved structural skylight glazing system which is characterized by a bottom closure carrier beam system wherein the skylight panels can be installed, maintained and replaced from inside a structure by detaching bottom-mounted closure members from the carrier beams and installing or removing multiple cap bolts from the carrier beams and companion exterior glazing caps, to secure and free the skylight panels, respectively.

Another object of the invention is to provide new and improved structural glazing systems for skylights which include a side closure carrier beam system utilizing carrier beam closures which are side-mounted on selected carrier beams to facilitate installation, maintenance and removal of the glass or plastic skylight panels from inside a structure without traversing the roof.

A still further object of this invention is to provide structural glazing systems for skylights which include multiple, spaced carrier beams oriented in a lattice or grid configuration and fitted with elevated glazing strips for receiving the bottom edges of adjacent glass or plastic skylight panels and multiple companion exterior glazing caps fitted with additional glazing strips for receiving and contacting the corresponding top edges of the adjacent panels for securing the panels between the glazing strips from inside the structure using cap bolts which extend upwardly through the carrier beams to threadably engage the exterior glazing caps. Still another object of the invention is to provide structural glazing systems for sloped and curved skylights in structures such as solaria, greenhouses, barrel vaults and like structures, which systems include multiple carrier beams mounted in spaced and intersecting relationship in the structure, the carrier beams each having an open chamber, an intersecting system of condensate gutters and a pair of bottom glazing strips attached to elevated glazing strip supports extending from flat shoulders in the carrier beams, for receiving the bottom edges of glass or plastic skylight panels, and further including cooperating exterior glazing caps for mounting on companion carrier beams, respectively, the exterior glazing caps characterized by top glazing strips for engaging the top corresponding edges of the skylight panels and securing the panels in position in the structure by means of cap bolts inserted through the carrier beams from inside the open chamber and threadably engaging the exterior glazing caps.

SUMMARY OF THE INVENTION

These and other objects of the invention are provided in structural glazing systems for skylights which include both bottom and side carrier beam closure systems, each of which systems is characterized by multiple, open-chamber carrier beams arranged in interconnecting relationship in a building or structure to define a lattice or grid; optional stabilizer clips spanning the carrier beams for enhancing the structural integrity of the carrier beams; a pair of bottom glazing strips provided on elevated glazing strip supports having support cradles extending from spaced shoulders formed in the carrier beams, for engaging the edges of the bottom surface of glass or plastic skylight panels to be installed in the system; multiple exterior glazing caps shaped and adapted to mount on the tops of the carrier beams, respectively, the exterior glazing caps provided with an additional pair of glazing strips for seating on the corresponding edges of the top surfaces of the glass panels; and spaced cap bolts extending into the open chamber and through openings provided in the carrier beams and threaded into a continuous screwboss provided in each of the exterior glazing caps, respectively, for mounting the glass or plastic skylight panels in a lattice or grid between the respective parallel and intersecting sets of exterior glazing caps and carrier beams. In a most preferred embodiment of the invention the carrier beams are fitted with elongated, removable closure strips that close the internal chambers in the carrier beams and conceal the cap bolt heads and optional stabilizer clips may be provided in the carrier beams for additional structural integrity, as desired.

BRIEF DESCRIPTION OF THE DRAWINGS

The invention will be better understood by reference to the accompanying drawings, wherein.

DESCRIPTION OF THE PREFERRED EMBODIMENTS

Figure 1:
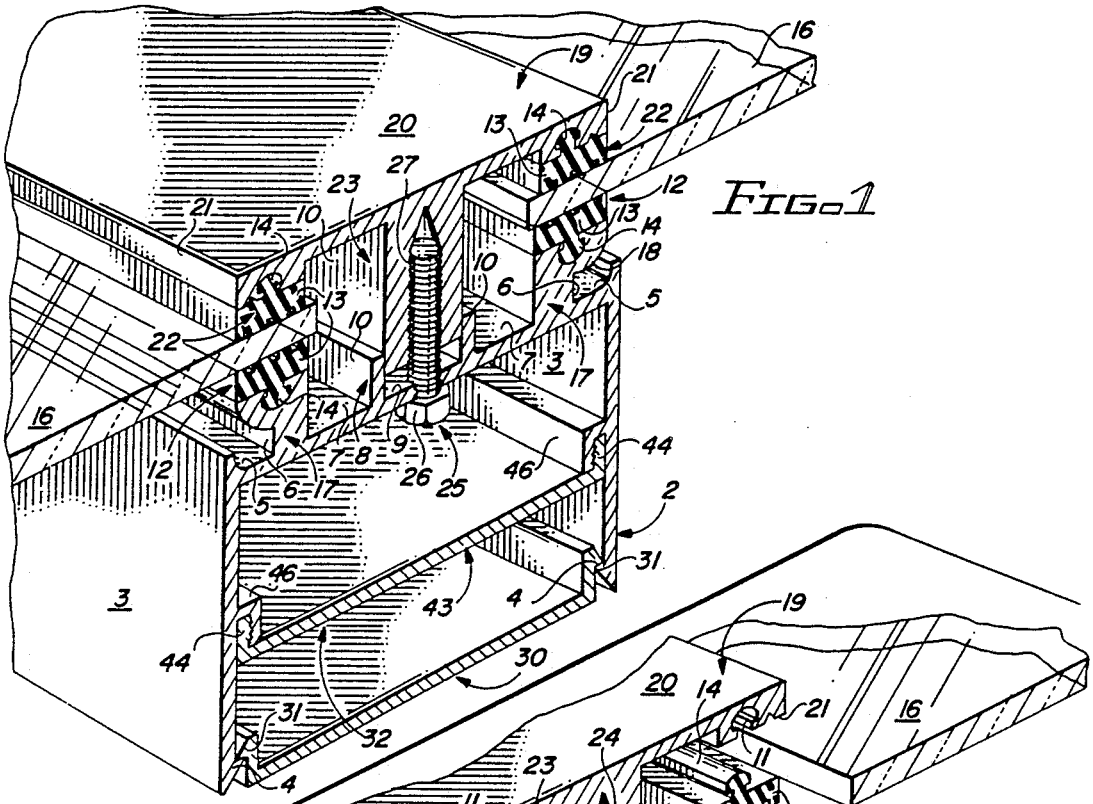
FIGURE 1 is a sectional view of an assembled bottom closure carrier beam embodiment of the sloped structural glazing system of this invention.
Figure 2:
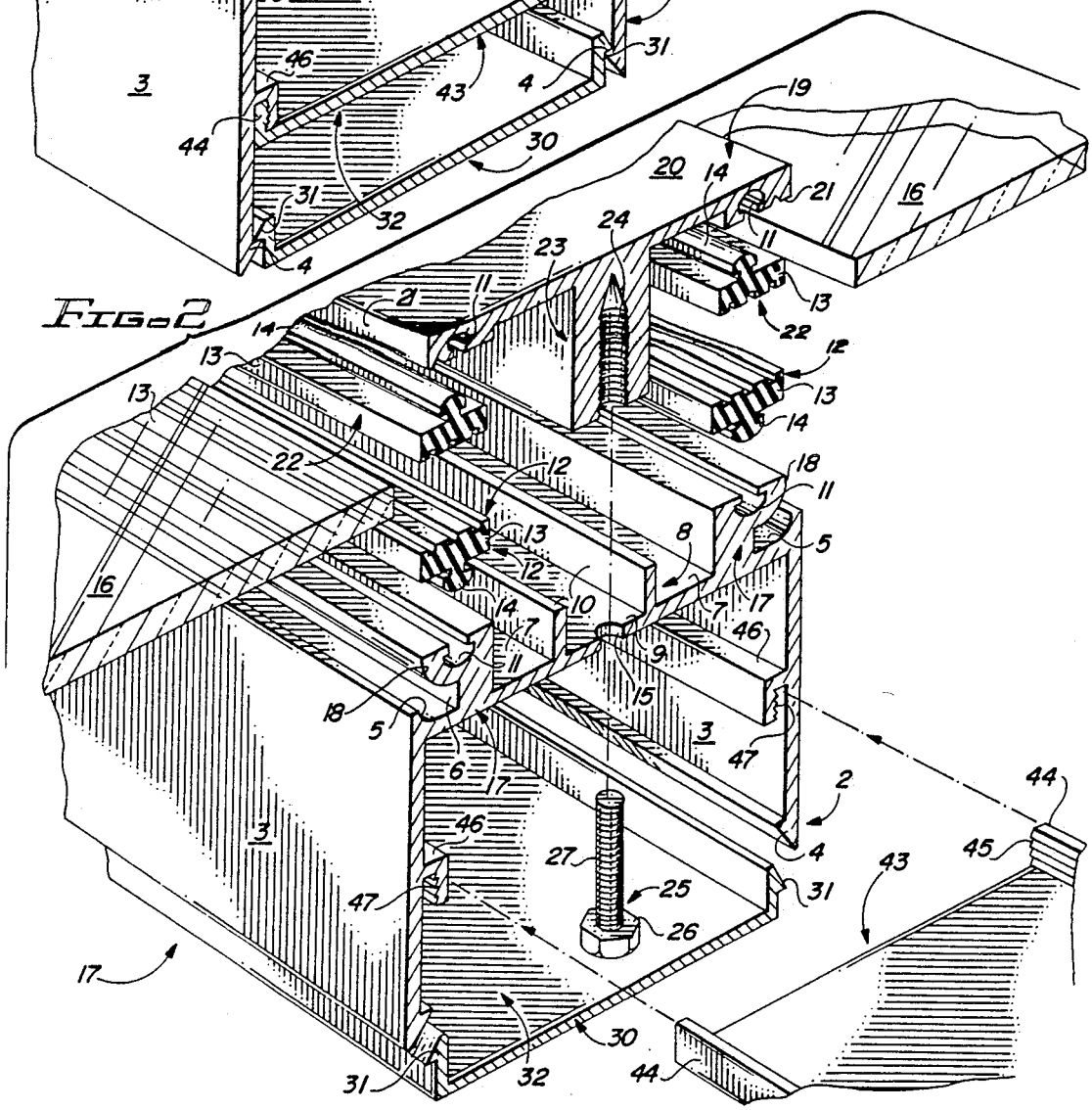
FIGURE 2 is an exploded view of the bottom closure carrier beam illustrated in FIG. 1.
Figure 3:
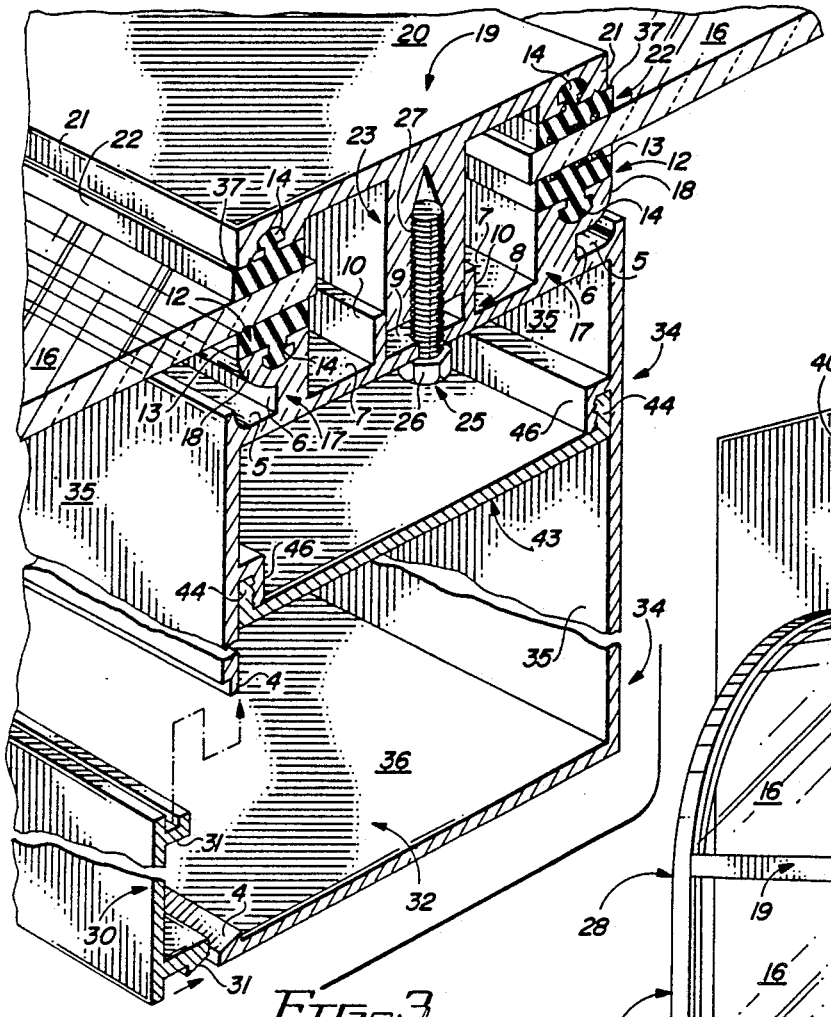
FIGURE 3 is a sectional view of an assembled side closure carrier beam embodiment of the sloped structural glazing system.

Referring initially to FIGS. 1 and 2-4 of the drawings, a roof structure 29, provided with the carrier beam 2 and head and sill carrier beam 34 embodiments of the structural glazing system of this invention is illustrated. The roof structure 29 is depicted as a sloped glazing system for purposes of illustration only and it will be appreciated that the structural components of the roof structure 29 can be utilized in many other glazing systems, as hereinafter further described. The roof structure 29 is characterized by a lattice or grid structure created by multiple, spaced and intersecting carrier beams 2 and head and sill carrier beams 34, which intersect at a 90-degree angle in spaced relationship, in order to define openings therebetween. While the angle of intersection of the carrier beams 2 and the head and sill carrier beams 34 is illustrated as 90 degrees, it will be further appreciated that the carrier beams 2 and head and sill carrier beams 34 may be installed in the roof structure 29 in any desired spatial orientation at any desired angle, according to the teachings of this invention. The head and sill carrier beams 34 lie over or adjacent to a wall 40, or a header, sill or jamb (not illustrated) in the roof structure 29 and are characterized by a side-access or closure design, as illustrated in FIG. 3, whereas the carrier beams 2 which extend across the roof of the roof structure 29 and are spaced from the walls 40 and the headers, sills or jambs, are characterized by a bottom access or closure design, as illustrated in FIGS. 1 and 2. Each of the carrier beams 2 and head and sill carrier beams 34 receive a corresponding exterior glazing cap 19,which fits over the top of a corresponding carrier beam 2 and head and sill carrier beam 34, respectively. Each exterior glazing cap 19 is designed to secure glass or plastic panels 16 between parallel carrier glazing strips 12, mounted in the support cradle 18 of upward-standing glazing strip supports 17 in the carrier beams 2 and the head and sill carrier beams 34, respectively, and cooperating parallel cap glazing strips 22, mounted on the exterior glazing caps 19, as hereinafter further described. Multiple cap bolts 25 project through openings provided in the carrier beams 2 in spaced relationship and threadably engage the exterior glazing caps 19, to secure the glass or plastic panels 16 between the carrier glazing strips 12 and the cap glazing strips 22, respectively, as hereinafter further described. An elongated carrier beam closure 30 removably seats in the bottom of each of the carrier beams 2 and in the sides of the head and sill carrier beams 34, respectively, to close the open chambers 32 in the carrier beams 2 and the head and sill carrier beams 34, conceal the cap bolts 25 and provide aesthetically pleasing bottom and side surfaces of the sloped structural glazing system 1 inside the host structure.

Referring now to FIGS. 1 and 2 of the drawings, the bottom closure or access embodiment of the sloped structural glazing system 1 is more particularly illustrated. The carrier beam 2 utilized in the bottom closure design includes a pair of parallel carrier beam sides 3, each of which terminates at the bottom in oppositely-disposed, spaced side flanges 4, for receiving the flange connectors 31 of a cooperating carrier beam closure 30, to close the chamber 32, as illustrated. A pair of primary condensate gutters 5 are defined in parallel relationship on each side of the carrier beam 2 by the top segments of the upward-standing carrier beam sides 3 and corresponding, parallel gutter extensions 6, respectfully. The gutter extensions 6 extend upwardly to define one side of the upward-standing glazing strip supports 17, which are mounted in spaced relationship on the carrier beam shoulders 7 and are each fitted with a support cradle 18, having an anchor slot 11 provided therein, as illustrated in FIG. 3. The carrier beam shoulders 7 terminate inwardly in a pair of upward-standing cap receiver sides 10, which, together with a connecting cap receiver base 9, define a central channel or cap receiver 8, wherein the cap receiver base 9 is coplanar with the carrier beam shoulders 7 and extends longitudinally along the entire length of each of the carrier beams 2 and runs parallel to and inwardly of the primary condensate gutters 5. Multiple base openings 15 are drilled or otherwise provided in spaced relationship in the cap receiver base 9 of the cap receiver 8 and the threaded shanks 27 of multiple cap bolts 25 are designed to extend through the base openings 15, to locate the bolt head 26 of each cap bolt 25 against the cap receiver base 9, as hereinafter further described. The top plate 20 of each exterior glazing cap 19 is fitted with a pair of longitudinal, parallel top plate flanges 21 on the outer edges thereof and a pair of parallel anchor slots 11 are provided in the top plate flanges 21, respectively, as further illustrated in FIG. 2. A continuous screwboss 23 projects downwardly from the center of the top plate 20 of the exterior glazing cap 19, between the top plate flanges 21 and screwboss threads 24 may be provided as an option in the parallel cap receiver sides 10 of the continuous screwboss 23 at spaced locations which correspond to each of the base openings 15 located in the cap receiver base 9 of the cap receiver 8. Alternatively, under circumstances where the continuous screwboss 23 is extruded from, or otherwise fabricated of a soft metal such as aluminum, the threaded shank 27 of each cap bolt 27 threads its way into the cap receiver sides 10 at spaced intervals when installed by a driving tool. Accordingly, the continuous screwboss 23 is designed to register with and seat inside the cap receiver 8 as the threaded shank 27 of each of the cap bolts 25 extends through a companion base opening 15 in the cap receiver base 9 and threadably engages screwboss threads 24 or alternatively, the soft metal in the parallel cap receiver sides 10, to secure each exterior glazing cap 19 to the top edge of a corresponding carrier beam 2. Referring again to FIG. 2 of the drawings, a pair of resilient sealing carrier glazing strips 12 are fitted on the support cradle 18 of the glazing strip supports 17, located on the carrier beam shoulders 7 of each carrier beam 2, by inserting the projecting glazing strip anchors 14 in the respective corresponding anchor slots 11. Similarly, the cap glazing strips 22 are fitted on the parallel top plate flanges 21 of each exterior glazing cap 19, by inserting the corresponding glazing strips anchors 14 into the corresponding anchor slots 11, respectively. Alternatively, under circumstances where the carrier glazing strips 12 and cap glazing strips 22 are not provided with companion glazing strip anchors 14, respectively, the carrier glazing strips 12 and cap glazing strips 22 may be glued into the positions noted above, according to the knowledge of those skilled in the art. Accordingly, a section of glass or plastic panel 16 can be inserted between the glazing strip body 13 of each of the carrier glazing strips 12 and the corresponding cap glazing strips 22 and the spaced cap bolts 25 then tightened in the cap receiver sides 10 to secure the glass or plastic panels 16 in place, as illustrated in FIGURE 1. After this installation step is completed, the respective carrier beam closures 30 may be installed on the bottom edges of the corresponding carrier beam sides 3 to cover and conceal the cap bolts 25, by matching the side flanges 4 with the flange connectors 31, as further illustrated in FIG. 2. Under circumstances where the carrier beam sides 3 are long and the chamber 32 is large, or the carrier beam structure otherwise requres reinforcement, a stabilizer clip 43 may be inserted between the carrier beam sides 3. In a preferred embodiment, a pair of upward-standing stabilizer clip legs 44 terminate each end of the stabilizer clip 43 and are fitted with leg serrations 45, for engaging corresponding flange serrations 47 provided in companion stabilizer clip flanges 46, downwardly-extending from the carrier beam sides 3.

Referring again to FIGS. 3 and 4 of the drawings, the side closure or access embodiment of the structural glazing system 1 is more particularly detailed. In the side closure design, a head and sill carrier beam 34 is constructed parallel to and above each wall 40 and a corresponding head and sill carrier beam base 36 extends from one of each of the head and sill carrier beam sides 35. A space is provided between the respective side flanges 4 and the opposite, shorter head and sill carrier beam side 35, in order to accommodate a side-mounted carrier beam closure 30, which removably seats in the shorter one of the head and sill carrier beam sides 35 by means of cooperating oppositely-disposed flange connectors 31 and the corresponding side flanges 4, as illustrated. The location of this space facilitates access to the chamber 32 provided in each of the head and sill carrier beams 34, to install and remove the spaced cap bolts 25, since the head and sill carrier beam base 36 is normally resting on or is in close proximity to the wall 40 or an extension of the wall 40, or above a header, sill or jamb (not illustrated) in the structure, and bottom access to the chamber 32 is difficult or impossible. As in the case of the carrier beam 2 illustrated in FIGS. 2 and 3, the head and sill carrier beam 34 is provided with a pair of parallel primary condensate gutters 5. The walls of the primary condensate gutters 5 extend upwardly from a pair of spaced, flat carrier beam shoulders 7, one of which walls in each of the primary condensate gutters 5 is characterized by a gutter extension 6, shaping one side of a pair of upward-standing glazing strip supports 17, respectively. The glazing strip supports 17 each terminate in a support cradle 18, which receives a resilient, sealing carrier glazing strip 12, as in the case of the carrier beams 2 illustrated in FIGS. 1 and 2. A cap receiver 8 also projects upwardly from the carrier beam shoulders 7 and receives multiple cap bolts 25 through spaced base openings 15, located in the cap receiver base 9, in order to threadably secure the continuous screwboss 23 of a corresponding exterior glazing cap 19 in the cap receiver 8, and the top plate 20, fitted with cap glazing strips 22, on the head and sill carrier beam 34. Further as in the case of the carrier beam 2, glass or plastic panels 16 are sandwiched between corresponding parallel pairs of the respective carrier glazing strips 12 and cap glazing strips 22 and are mounted and sealed in this position by tightening the spaced cap bolts 25 from inside each chamber 32. A stabilizer clip 43 may also be mounted in the carrier beam 2 between the parallel head and sill carrier beam sides 35 by means of the upward-standing stabilizer clip legs 44 and companion downwardly-projecting stabilizer clip flanges 46, as in the carrier beam 2 illustrated in FIGS. 1 and 2.

Figure 4:
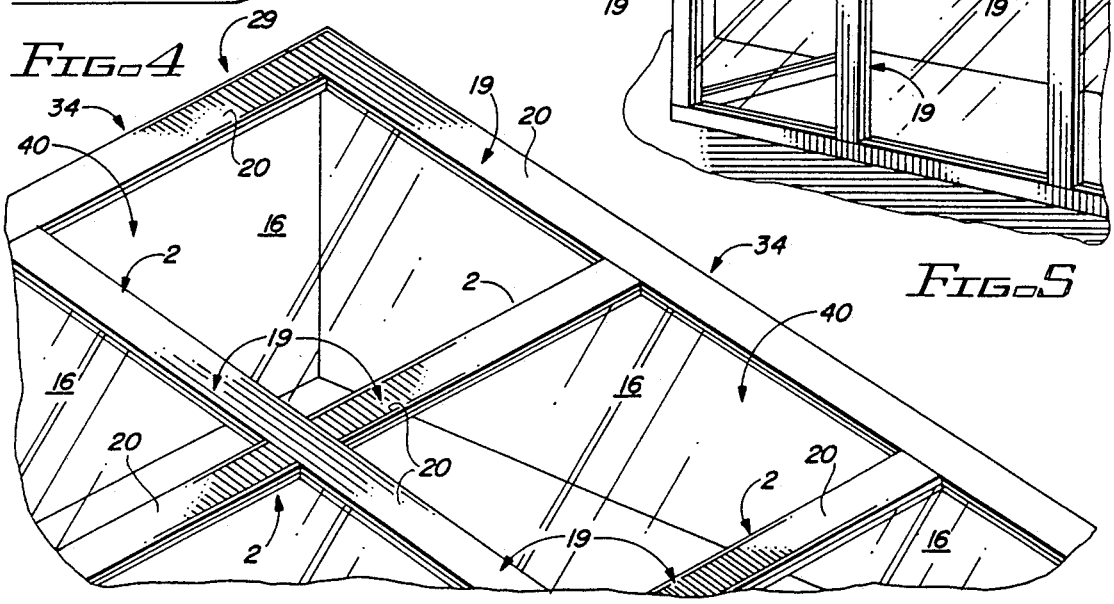
FIGURE 4 is a top view, partially in section, of an installed sloped structural glazing system according to this invention.

Referring again to the drawings, it will be appreciated that the bottom closure and side closure designs of the sloped structural glazing system 1 are designed to facilitate mounting one or more glass or plastic panels 16 in a lattice or grid which is characterized by joints, intersections or connecting points between respective carrier beams 2 and between the carrier beams 2 and cooperating head and sill carrier beams 34. In these intersectional connections, it should be remembered that the bottom closure carrier beams 2 are constructed as illustrated in FIGS. 1 and 2, while the side closure head and sill carrier beams 34 are constructed as illustrated in FIG. 3, as heretofore described. The intersection of these structural components is illustrated in FIG. 4. In a most preferred embodiment of the invention, the respective top plates 20 of the exterior glazing caps 19 which correspond to the subject carrier beams 2 are cut and shaped to butt against the sides of the companion top plates 20 which correspond to the corresponding head and sill carrier beams 34. Furthermore, the respective primary condensate gutters 5 are mitered at the point of intersection (not illustrated) to more efficiently carry condensate away from the glass or plastic panels 16.

Figure 5:
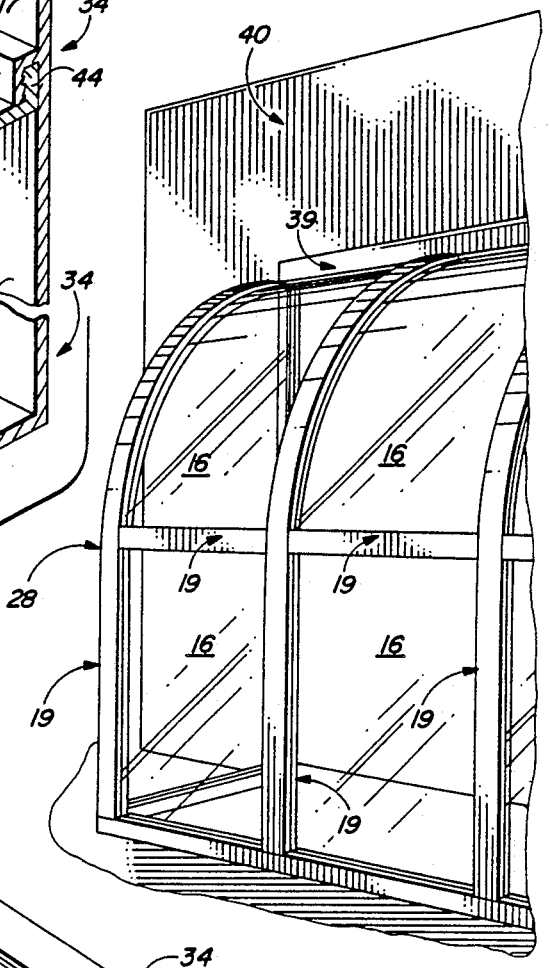
FIGURE 5 is a perspective view, partially in section, of a typical curved roof or greenhouse structural glazing system embodiment of the invention.

Referring again to FIG. 5 of the drawings, it will be appreciated that the structural elements of the sloped structural glazing system 1 can be utilized to create a curved roof structure, as in the case of the greenhouse structure 28, as well as in the sloped system as illustrated in FIG. 4. Under these circumstances, a head and sill carrier beam 34 may be utilized at the top of the greenhouse structure 28, in combination with a strip of head flashing 39.

It will be appreciated by those skilled in the art that the various structural components of the structural glazing system of this invention are preferably extruded from a soft, light metal such as aluminum. However, certain components in specific applications not requiring large glass or plastic panels or characterized by minimum load-bearing requirements, may be injection-molded or extruded of plastic materials, according to the knowledge of those skilled in the art. Furthermore, the structural glazing system may be used to mount skylight panels of any desired size, shape, thickness and composition, with the appropriate adjustment for panel thickness effected by using cap bolts 25 having a threaded shank 27 of suitable length. Panels which may be mounted and maintained according to the structural glazing system of this invention are typically constructed of glass and plastic, such as "Plexiglass" and other transparent materials, in non-exclusive particular.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A structural glazing system for mounting at least one skylight panel in a structure, comprising a plurality of carrier beams arranged in interconnecting relationship to define a grid having at least one opening for receiving the panels; a pair of supports upward-standing from each of said carrier beams in spaced relationship; an open chamber extending substantially along the entire length of each of said carrier beams and a carrier beam closure arranged substantially in alignment with said chamber in interconnecting relationship and adapted to removably engage each of said carrier beams and close said open chamber, respectively; stabilizer clip means removably attached to said carrier beams between said supports and said carrier beam closure for strengthening said carrier beams; a pair of cradles shaped in the top of each of said supports and an anchor slot provided in each of said cradles; a first pair of resilient sealing strips engaging said anchor slot in said cradles, respectively, for receiving the bottom edges of the panels; a pair of primary condensate gutters provided in each of said carrier beams in spaced, substantially parallel relationship, said primary condensate gutters extending substantially along the entire length of said carrier beams, respectively; a plurality of exterior glazing caps arranged in interconnecting relationship and adapted to mount on the top of said carrier beams, respectively; a second pair of resilient sealing strips provided on the bottom of each of said exterior glazing caps for seating on the top edges of the panel, said second pair of sealing strips oriented substantially in alignment with said first pair of sealing strips, respectively; and fastening means extending through said carrier beams and engaging said exterior glazing caps, respectively, whereby the edges of the panel are secured between corresponding aligned pairs of said first pair of sealing strips and said second pair of sealing strips, respectively, responsive to tightening said fastening means.

2. The structural glazing system of claim 1 wherein said carrier beam closure is adapted to close the bottom of said carrier beams, respectively.

3. The structural glazing system of claim 1 wherein said carrier beam closure is adapted to close one side of said carrier beams, respectively.

4. The structural glazing system of claim 1 wherein said carrier beam closure is adapted to close the bottom of first selected ones of said carrier beams and one side of second selected ones of said carrier beams, respectively.

* * * * *